US008549981B2

(12) United States Patent
Chiappini et al.

(10) Patent No.: US 8,549,981 B2
(45) Date of Patent: Oct. 8, 2013

(54) AMMUNITION HOIST

(75) Inventors: Andrea Chiappini, La Spezia (IT); Andrea Bruschi, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 93 days.

(21) Appl. No.: 13/151,931

(22) Filed: Jun. 2, 2011

(65) Prior Publication Data

US 2011/0315001 A1 Dec. 29, 2011

(30) Foreign Application Priority Data

Jun. 4, 2010 (IT) ..... TO2010A0466

(51) Int. Cl.
*F41A 9/00* (2006.01)

(52) U.S. Cl.
USPC ..... 89/46

(58) Field of Classification Search
USPC ..... 89/46
See application file for complete search history.

(56) References Cited

U.S. PATENT DOCUMENTS

| | | | | | |
|---|---|---|---|---|---|
| 2,855,828 | A | * | 10/1958 | Girouard et al. | 89/45 |
| 3,122,967 | A | * | 3/1964 | Johnson | 89/46 |
| 3,218,930 | A | * | 11/1965 | Girouard et al. | 89/45 |
| 4,395,936 | A | * | 8/1983 | Lundin et al. | 89/46 |
| 4,495,853 | A | * | 1/1985 | Gottwaldt | 89/46 |
| 5,131,316 | A | | 7/1992 | Lawrence et al. | |
| 2011/0258898 | A1 | * | 10/2011 | Chiappini et al. | 42/6 |

FOREIGN PATENT DOCUMENTS

| | | |
|---|---|---|
| FR | 689909 | 6/1930 |
| FR | 960284 | 10/1949 |

OTHER PUBLICATIONS

Italian Search Report for Application No. TO20100466 mailed Feb. 24, 2011.

* cited by examiner

*Primary Examiner* — Michael David
(74) *Attorney, Agent, or Firm* — Merchant & Gould P.C.

(57) ABSTRACT

An ammunition hoist (1) includes a supporting beam (4) set alongside a hollow guide element, and a movement system (5), adapted to enable movement of the ammunition (3) along a supporting beam (4) between a first level and a second level set at a different height with respect to one another. The hoist includes moving equipment (6), sliding with respect to the supporting beam (4) and to which the ammunition (3) is associated at least temporarily; the movement of the ammunition (3) occurs in an automated way from and towards the first or second level.

13 Claims, 3 Drawing Sheets

AMMUNITION HOIST

This application claims benefit of Serial No. TO 2010 A 000466, filed 4 Jun. 2010 in Italy and which application is incorporated herein by reference. To the extent appropriate, a claim of priority is made to the above disclosed applications.

BACKGROUND OF THE INVENTION

The present invention relates the field of the auxiliary devices for the movement of ammunitions and, more in detail, it relates to an ammunition hoist.

It is known that ammunitions, in particular the especially heavy ones, which are suited to be manually moved by one or more operators due to their dimensions and to their weight, are moved by means of hoists that are specially designed for this purpose.

In particular, in the naval field, ammunitions typically comprise a first part, the so-called projectile (i.e. the element which is physically expelled from the piece when fired), and a second part containing a propulsive charge (which provides the kinetic energy needed by the projectile to be expelled from the carriage of the piece).

Said ammunitions are stowed on a first lower deck of the ship and have to be able to be transported to the deckhouse, in order to then reach the turret of the piece from which they can be fired.

In order to do so, the hoist must lift the ammunitions through a second intermediate deck (main deck) or even through different decks, before reaching the deckhouse of the ship.

The ammunition hoists of the current type use a plurality of different stages, which are arranged in series and have the task of transporting the ammunition from the first deck, where there is a store configured to store the ammunitions, up to the so-called ladle, substantially in correspondence to the piece.

The structure of the hoists of the known type is determined not so much by functional reasons, but rather by historical reasons; indeed, originally, there were two hoists at the level of the first deck: the first one was destined to the projectile and the second one was destined to the charge.

The presence of two hoists necessary leads to the presence of two different motors, each one provided with a mechanical drive line and relative servomechanisms, as well as to the presence of a well determined stroke control between the different motors, which is possible thanks to the use of a cathode follower.

Furthermore, the hoists of the traditional type only allow a manual unloading of the ammunition (the so-called strike-down phase). In detail, the ammunition was manually taken from an upper station, instead of being delivered to the loading ladle, and it was brought back to the store.

SUMMARY OF THE INVENTION

The object of the present invention is to describe an ammunition hoist, which does not present the drawbacks described above.

BRIEF DESCRIPTION OF THE DRAWINGS

The invention will now be described with reference to the accompanying drawings, which illustrate a non-limiting embodiment, wherein.

DETAILED DESCRIPTION

Figure 1:
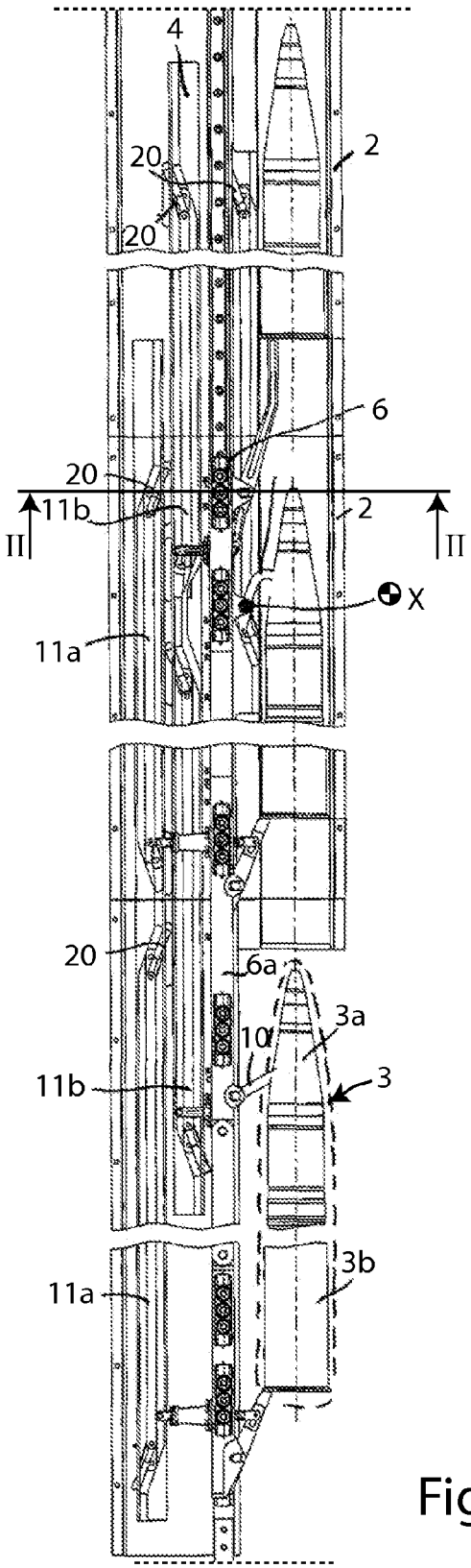
FIGS. 1, 2 and 3 illustrate respective side views of an ammunition hoist according to the present invention.
Figure 2:
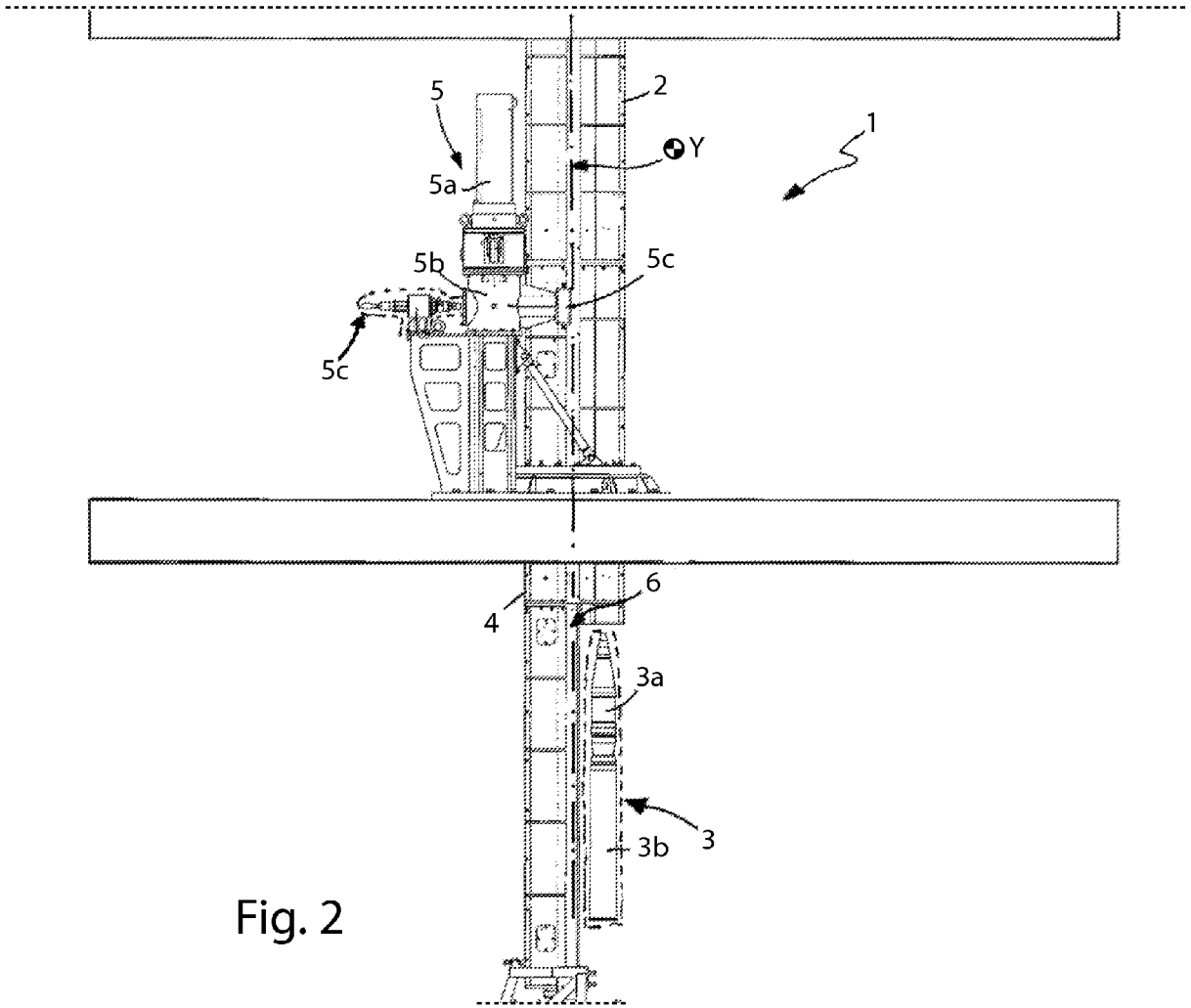

With reference to FIGS. 1 and 2, the reference number 1 indicates an ammunition hoist as a whole.

Ammunition hoist 1 is designed to be preferably installed inside a warship or a submarine, so as to be positioned in a place where it can reach its maximum extension, in such a position that allows it to pass through the height of one or more decks of the ship or of the submarine.

In particular, ammunition hoist 1 is arranged—when the ship or the submarine is in neutral trim—along a vertical axis and extends between a first lower level (typically the lowest deck of the ship or of the submarine, where there are the respective ammunition stores) and a second higher level (for example the deck house of a ship or the main deck of a submarine).

Ammunition hoist 1 comprises:

- a hollow guide element 2, preferably with a circular shape, within which heavy ammunitions 3 for artillery, for example ship artillery, are caused to translate, said ammunitions comprising, in turn, a first part called projectile 3*b* (in use, the part that is fired out of the carriage) and a second part of charge 3*a* having a rear base (or terminal part) 3*c* (in use, the part aimed at the propulsion of the projectile).
- a supporting beam 4, set alongside the above-mentioned hollow guide element 2 and fitted to the body of a ship, along which ammunition 3 is parallelly moved; and
- a motor assembly 5 for the movement of ammunitions 3; in particular, motor assembly 5 comprises, besides an actual motor 5*a*, also an epicycloidal reducer 5*b* coupled to the above-mentioned motor 5*a*, which, in turn, is mechanically coupled to a pinion cogwheel 5*c* and to a manual handling system 5*d*, which is useful in case that, due to an absence of the power source of motor 5*a*, the motive power for the movement of the ammunitions is no longer available.

In particular, supporting beam 4 presents such a length to pass through one or more decks of the ship or of the submarine on which ammunition hoist 1 is installed, so as to allow the ammunition to reach, for example, a height equal to the height of the deckhouse of a ship.

Ammunition hoist 1 comprises, furthermore, a moving equipment 6, which is constrained in a sliding manner to supporting beam 4, so as to slide along it in a rectilinear direction defined by a first vertical axis Y, which, by the way, is parallel to the direction along which supporting beam 4 extends in its maximum length. Moving equipment 6 is designed so as to transport at least one ammunition 3 from the first to the second level of the ship or of the submarine.

More in detail, moving equipment 6 comprises at least one track 6*a*, which slides along supporting beam 4, since it is constrained to the latter by means of constraining means, such as guides and/or meshing wheels, which are able to exercise a low sliding friction during the translation along the first axis Y.

Moving equipment 6 comprises, furthermore, a rack 7, which generates a meshing means together with pinion 5*c* of motor assembly 5. Rack 7 is arranged parallel to the first axis Y and is associated to a track 6*a*; therefore, since the carriage has to move between the first and the second level during the rotation of pinion 6*a* moving rack 7, the latter has to be long enough to allow the track 6*a* itself to start from the first level, even though motor 5*a* and relative pinion 5*c* are arranged at an intermediate level between the first and the second level.

In a preferred embodiment, tracks 6*a* are more than one and are arranged in series with respect to one another, so that, when they are loaded with respective ammunition 3, ammunitions 3 are arranged in series, as well.

In order to constrain ammunition 3 to the respective track 6*a* in a stable and safe manner, each track 6*a* is provided with respective blocking elements 10, which are respectively designed to lock ammunition 3 in a rear terminal part 3*c* and in an upper terminal part.

In particular, the blocking elements are:

of a first type, also called lower "finger", which is adapted to support ammunition 3 during its translation along the first axis Y;

of a second type, also called "anti-bounce finger", whose aim is that of locking the point of projectile 3*b*, so as to prevent it from oscillating.

Since ammunition 3 is typically loaded on ammunition hoist 1 with the point of projectile 3*b* upwards and charge 3*a* under projectile 3*b* itself, the fingers of the first type support ammunition 3 from the side of base 3*c*.

For this reason, for each track 6*a*, supporting elements 10 are spaced apart from one another at a distance which is substantially equal to the sum of the lengths of the projectile and of the charge.

Each supporting element 10 is pivoted to the respective track 6*a* in correspondence to a pair of eyelets 10*a*, 10*b* and, therefore, it can rotate about a rotation axis X, which extends orthogonal to the first axis Y; as a consequence, the rotation plane of each supporting element 10 is parallel to the plane along which the tracks 6*a* translate.

Supporting beam 4 comprises a plurality of lateral guides 11*a*, 11*b*, 11*c*, 11*d*, which are arranged on two opposite sides of supporting beam 4 itself and extend along the whole length of the latter.

Said lateral guides allow a "control" of the rotation of supporting elements 10, thus causing, according to their rotation, the locking and the release of ammunition 3 from the respective track 6*a*, allowing ammunition 3 itself to move by one step on mobile track 6*a* inside hollow guide element 2. Alternatively, with a different configuration of supporting elements 10, supporting elements 10 themselves also allow the ammunition to be delivered to the fixed supports of hollow guide element 2 itself.

Figure 3:
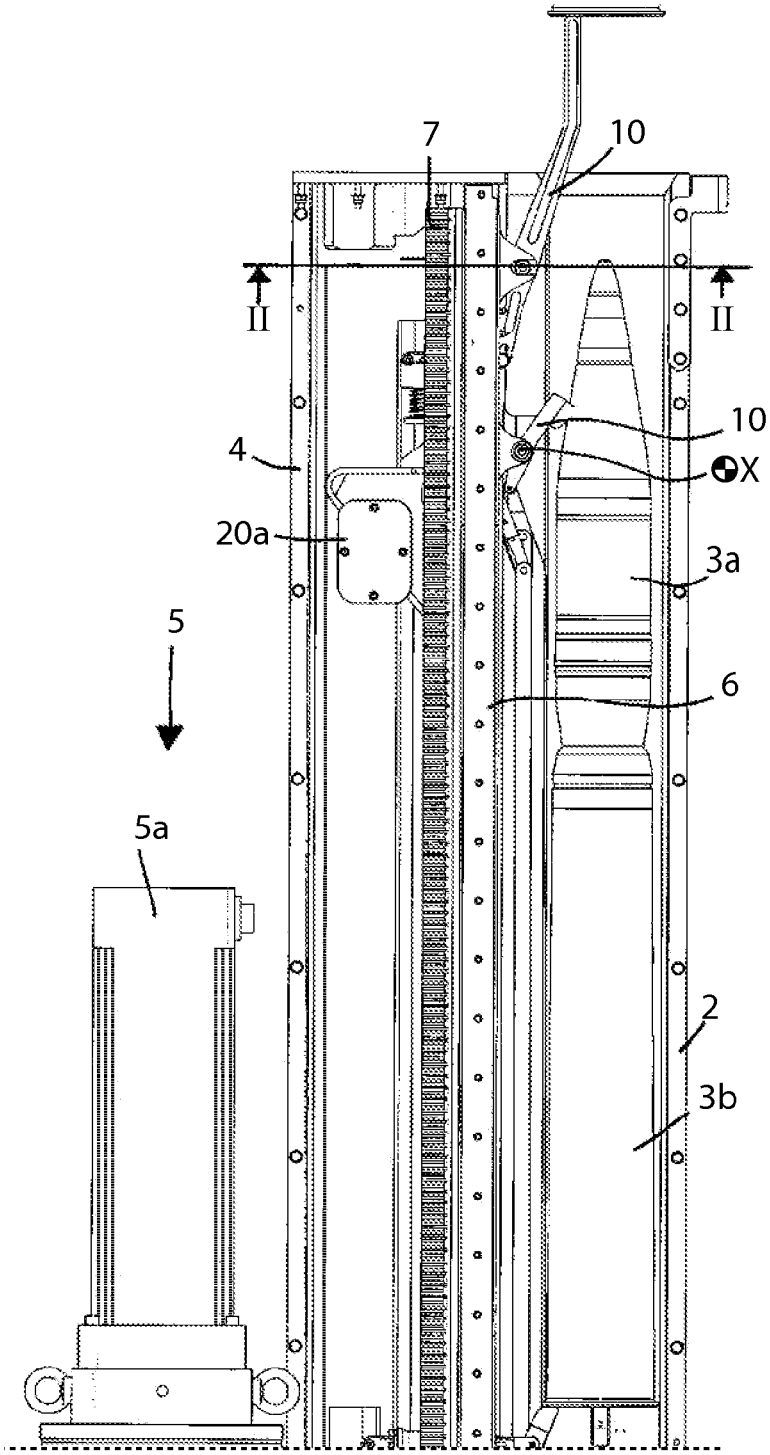

As illustrated more in detail in FIG. 3, in particular, for each side of supporting beam 4, there is a pair of parallel lateral guides 11*a*, 11*b*; 11*c*, 11*d*, one of these pairs being more internal and closer to track 6*a*, and the other pair being more external and farther from the track itself; said guides are spaced apart by a plurality of exchange deviators 20, each of which is provided with a respective actuator 20*a*.

Supporting elements 10 extend beyond the tracks 6*a* until they reach the area in correspondence to lateral guides 11*a*, 11*b*; 11*c*, 11*d* and, right in correspondence to said guides, they present respective pins 10*c* adapted to be inserted into the lateral guides.

During the translation of ammunition 3 operated by motor 5*a*, which—once set in rotation—rotates pinion 5*c*, which, by meshing with rack 7, moves track 6*a* along the first axis 11, when pin 10*c* of a blocking element 10 meets an exchange deviator 20, this pin 10*c* can either continue its travel on the lateral guide in which it has traveled until now, or, alternatively, exchange its position and move on the lateral guide parallel to the previous one, according to the position of exchange deviator 20 itself.

By changing its position between one lateral guide 11*a* and the other 11*b*, pin 10*c* ends up arranged at two different distances with respect to the rotation axis and, consequently, it causes the rotation of the supporting element itself, since the rotation point is fixed with respect to track 6*a*.

Exchange deviators 20 are arranged at a distance from one another, which is measured along the direction of maximum extension of the supporting beam and is such that it allows the opening and the closing of the different supporting elements 10 when a new ammunition 3 is loaded and, consequently, when the ammunition arranged at the highest height is unloaded.

On the two opposite sides of supporting beam 4, exchange deviators 20 are arranged at a same height with respect to the ends of beam 4 itself.

In detail, when an ammunition has to be transported between the first and the second level (strike-up phase), with an empty hoist, first of all rack 7 and, consequently, tracks 6 are brought to the first level by means of a rotation of pinion 6*c* operated by motor assembly 5; when the height equal to the first level is reached, exchange deviators 20 cause the pins of supporting elements 10 to move, so as produce, by means of a rotation, their opening (supporting fingers), so that first ammunition 3 can be loaded. Subsequently, motor 5*a* is caused to rotate in an opposite direction with respect to the previous one, so as to allow the lifting of track 6 and, consequently, of the first ammunition 3. When the lifting of the first ammunition 3 has ended, motor 5*a* reverses again the motion, so as to bring down again track 6*a*. If the hoist according to the present invention can simultaneously transport different ammunitions, the previous step of "ending the lifting of ammunition 3" does not correspond to the transfer of ammunition 3 itself to the second and highest level, but, on the contrary, ammunition 3 is transferred to an intermediate level, in correspondence to which there are further exchange deviators 20, which allow the rotation and the subsequent opening and closing of supporting elements 10 respectively of the lower and of the upper track 6. The whole phase involving the translation of ammunitions 3 between the first and the second level occurs in an automatic way.

Exchange deviators 20, furthermore, also allow ammunition hoist 1 according to the present invention to perform the so-called "strike-down" of the ammunition inside the hollow guide element 2. In detail, the "strike-down" phase is an automatic operation, through which ammunitions 3 can be brought back from the duct of ammunition hoist 1 according to the present invention to the store.

Thus, ammunition hoist 1 substantially allows not only an upwards translation of ammunitions 3 starting from the lower level, but also a downwards movement of ammunitions 3. Therefore, hoist 1 according to the present invention has a reversible operation and is automated both in the strike-up phase and in the strike-down phase.

The automation of the strike-up and strike-down phases is supervised by electronic control means. Said electronic control means can either interact exclusively with ammunition hoist 1 according to the present invention or, alternatively, have a data processing capability that they share with other electromechanical systems.

During this phase, auxiliary blocking elements 10*a* (also known as non-return pawls) intervene in the same position of the blocking fingers, i.e. on the base of charge 3*b*, thus temporarily locking ammunition 3; auxiliary blocking elements 10*a*, unlike blocking elements 10, are fixed with respect to the ship and are not mobile like the rest of moving equipment 6.

Besides the above-mentioned ammunitions of the standard type, which have been previously described, ammunition hoist 1 according to the present invention can also use ammunitions of a different type, such as, for example, HEFSDS ammunitions (High Explosives Fin Stabilized Discarding Sabot), which basically are subcalibre, non self-propelled ammunitions having a guided version comprising aerodynamic controls, inertial/GPS navigation and, in some subtypes, a terminal guidance system; these ammunitions, nowadays called Vulcano, are characterized by a very long range (up to 120 km) and a high degree of accuracy (CEP<20 m).

The advantages of ammunition hoist 1 according to the present invention are known in the light of the previous description. In particular, it allows the translation of one or more ammunitions inside a ship or a submarine, between a first level and a second level distinct from one another and spaced apart by one or more decks, with a single motor 5*a* and by means of a moving equipment, which can be configured in a modular manner by changing the number of tracks 6 and the subsequent length of rack 7.

For this reason, ammunition hoist 1 according to the present invention can be easily adjusted to different configurations and is not limited, thanks to its easy installation, neither to the number of decks of the ship or of the submarine nor to the dimension of ammunitions 3 to be translated.

Some variations can be applied to the device described above. More in detail, motor assembly 5 can be replaced by an oleodynamic system.

Furthermore, the rack can be replaced by a similar meshing means, such as a chain coupled to pinion 5*c*.

The invention claimed is:

1. An ammunition hoist, comprising:

a supporting beam set alongside a hollow guide element, and a movement system, for enabling movement of at least one ammunition along said supporting beam between a first level and a second level set at a different height with respect to one another;

moving equipment sliding with respect to said supporting beam and to which said ammunition is associated at least temporarily; said moving equipment comprising a plurality of blocking elements for blocking said ammunition; said supporting beam comprising a plurality of guides or recesses for guiding said blocking elements wherein movement of said ammunition occurs in an automated way from and towards said first level or said second level; and wherein said guides are set in pairs on each side of said supporting beam; each pair of guides comprising a first, internal guide and a second external, guide.

2. The ammunition hoist according to claim 1, wherein said moving equipment comprises:

at least one track, which is mobile with respect to said supporting equipment;

and wherein said moving equipment moves axially along a first axis parallel to a direction of maximum extension of said supporting beam.

3. The ammunition hoist according to claim 2, wherein said moving equipment further comprises means for meshing with said movement system.

4. The ammunition hoist according to claim 3, wherein said meshing means comprise a rack and wherein said movement system comprises a motor having at least one cogwheel meshing on said rack.

5. The ammunition hoist according to claim 3, wherein said meshing means comprise a chain.

6. The ammunition hoist according to claim 2, wherein each of said blocking elements is rotatably pivoted on a respective support of said track and turns about an axis of rotation.

7. The ammunition hoist according to claim 6, wherein said axis of rotation is set perpendicular to said first axis.

8. The ammunition hoist according to claim 1, wherein said movement system is an oleodynamic system.

9. The ammunition hoist according to claim 1, wherein the hollow guide element enables passage within the hollow guide element of at least one ammunition.

10. The ammunition hoist according to claim 1, further comprising auxiliary blocking elements, and wherein said ammunition comprises a first part or projectile and a second part or charge; said auxiliary blocking elements temporarily blocking said ammunition at a point corresponding to a base of said charge.

11. The ammunition hoist according to claim 1, further comprising electronic control means supervising movement of said ammunitions between said first level and said second level.

12. An ammunition hoist, comprising:

a supporting beam set alongside a hollow guide element;

a movement system, for enabling movement of at least one ammunition along said supporting beam between a first level and a second level set at a different height with respect to one another;

moving equipment sliding with respect to said supporting beam and to which said ammunition is associated at least temporarily; said moving equipment comprising a plurality of blocking elements for blocking said ammunition; said supporting beam comprising a plurality of guides or recesses for guiding said blocking elements;

a plurality of exchange deviators and a plurality of actuators for said exchange deviators; said plurality of exchange deviators being configured for enabling rotation of said blocking elements;

wherein movement of said ammunition occurs in an automated way from and towards said first level or said second level.

13. The ammunition hoist according to claim 12, wherein said exchange deviators have a first position of use for translation of a pin of said blocking elements from said first internal guide to said second external guide and a second position of use for translation of a pin of said blocking elements from said second external guide to said first internal guide.

* * * * *